US008467709B2

(12) United States Patent
Kogure et al.

(10) Patent No.: US 8,467,709 B2
(45) Date of Patent: Jun. 18, 2013

(54) IMAGE FORMING APPARATUS HAVING A MOVABLY SUPPORTED TRANSFER BELT DETECTOR

(75) Inventors: Seiichi Kogure, Kanagawa-ken (JP); Katsuhito Haruno, Kanagawa-ken (JP); Masakazu Imai, Kanagawa-ken (JP); Hiroki Nakamatsu, Kanagawa-ken (JP)

(73) Assignee: Ricoh Company, Limited, Tokyo (JP)

( * ) Notice: Subject to any disclaimer, the term of this patent is extended or adjusted under 35 U.S.C. 154(b) by 175 days.

(21) Appl. No.: 13/015,150

(22) Filed: Jan. 27, 2011

(65) Prior Publication Data

US 2011/0211855 A1 Sep. 1, 2011

(30) Foreign Application Priority Data

Feb. 26, 2010 (JP) ..... 2010-042991

(51) Int. Cl.
*G03G 15/01* (2006.01)
*G03G 15/00* (2006.01)

(52) U.S. Cl.
USPC ..... 399/301; 399/49

(58) Field of Classification Search
USPC ..... 399/301, 302, 308, 121, 74, 49, 66
See application file for complete search history.

(56) References Cited

U.S. PATENT DOCUMENTS

| | | | | |
|---|---|---|---|---|
| 7,499,669 | B2 | 3/2009 | Adachi et al. | |
| 7,801,471 | B2 | 9/2010 | Adachi et al. | |
| 7,817,954 | B2 | 10/2010 | Yano et al. | |
| 2009/0035038 | A1 | 2/2009 | Sugimoto et al. | |
| 2009/0257799 | A1 | 10/2009 | Haruno et al. | |
| 2009/0311004 | A1 | 12/2009 | Naruse et al. | |
| 2010/0003051 | A1 | 1/2010 | Sekina et al. | |
| 2010/0003052 | A1 | 1/2010 | Nakamatsu et al. | |
| 2010/0008696 | A1 | 1/2010 | Furuya et al. | |
| 2010/0008706 | A1 | 1/2010 | Sugiura et al. | |
| 2010/0034549 | A1 | 2/2010 | Nakamatsu et al. | |
| 2010/0067952 | A1 | 3/2010 | Fujita et al. | |
| 2010/0080625 | A1 | 4/2010 | Furuya et al. | |
| 2010/0239302 | A1 | 9/2010 | Naruse et al. | |
| 2011/0229243 | A1 * | 9/2011 | Shiba et al. | 400/618 |

FOREIGN PATENT DOCUMENTS

| | | | |
|---|---|---|---|
| JP | 2002-72574 | | 3/2002 |
| JP | 2003076111 | A * | 3/2003 |
| JP | 2007-187700 | | 7/2007 |
| JP | 2008-40454 | | 2/2008 |

* cited by examiner

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

The image forming apparatus includes an image bearing member bearing a toner image; a driving roller and a tension roller movable in such a direction that the interval between the rollers changes; a transfer belt stretched by the rollers to feed a receiving material so that the toner image on the image bearing member is transferred onto the receiving material or to directly receive the toner image from the image bearing member; a detector opposed to the tension roller with the belt therebetween to optically detect a mark on the belt, wherein the detector is movably supported while biased toward the tension roller, and the moving direction of the tension roller is substantially the same as an optical axis of light emitted by the detector; and a regulator to regulate movement of the tension roller and the detector in a direction perpendicular to the moving direction of the tension roller.

10 Claims, 5 Drawing Sheets

IMAGE FORMING APPARATUS HAVING A MOVABLY SUPPORTED TRANSFER BELT DETECTOR

BACKGROUND OF THE INVENTION

1. Field of the Invention

The present invention relates to an image forming apparatus. Particularly, the present invention relates to an image forming apparatus having a transfer belt tightly stretched by a driving roller and a tension roller.

2. Description of the Related Art

Electrophotographic image forming apparatuses are broadly classified into direct-transfer type image forming apparatuses in which a toner image formed on a surface of an image bearing member such as photoreceptors is directly transferred onto a receiving material such as paper sheets, and indirect-transfer type image forming apparatuses in which one or more toner images formed on surfaces of multiple image bearing members are primary transferred onto an intermediate transfer belt, and the toner images are then transferred onto a receiving material. The indirect-transfer type image forming apparatuses are typically used as multi-color image forming apparatuses (such as full color image forming apparatuses).

Multi-color image forming apparatuses using an intermediate transfer belt typically include the following image forming processes:

(1) a toner image forming process in which different color toner images are formed on plural image bearing members such as photoreceptors;
(2) a primary transfer process in which the color toner images are sequentially transferred onto a surface of an intermediate transfer belt to form a combined multi-color toner image on the intermediate transfer belt;
(3) a secondary transfer process in which the combined multi-color toner image is transferred onto a receiving material; and
(4) a fixing process in which the combined multi-color toner image is fixed to the receiving material, resulting in formation of a multi-color image.

Direct-transfer type multi-color image forming apparatuses typically include the following image forming processes:

(1) a toner image forming process in which different color toner images are formed on plural image bearing members such as photoreceptors;
(2) a transfer process in which the color toner images are sequentially transferred onto a receiving material fed by a direct-transfer belt similar to such an intermediate transfer belt as mentioned above while contacted therewith to form a combined multi-color toner image on the receiving material; and
(4) a fixing process in which the combined multi-color toner image is fixed to the receiving material, resulting in formation of a multi-color image.

Hereinafter, an intermediate transfer belt and a direct-transfer belt are referred to as a transfer belt in this application.

Such a transfer belt is typically tightly stretched by plural rollers (such as a combination of a driving roller and a tension roller) while a tension is applied to the transfer belt using a member such as a tension roller, so that each of the plural rollers does not cause slipping and an image misalignment problem, which is caused by the slipping and in which different color toner images on image bearing members are not transferred to the desired positions of the transfer belt or a receiving material, resulting in formation of a misaligned color image.

In addition, there are image forming apparatuses having a transfer belt stretched by a combination of a driving roller and a movable roller, which serves as a tension roller and is movable in such a direction that the interval between the driving roller and the movable roller is changed, to miniaturize the image forming apparatuses.

Some of such image forming apparatuses include a detector, which is provided so as to be opposed to a tension roller to optically detect a toner image formed on a transfer belt to adjust transfer positions of the following toner images and to prevent occurrence of the image misalignment problem, or to optically detect marks formed on a transfer belt at regular intervals to control the moving speed of the transfer belt. For example, there is an image forming apparatus in which an image reading sensor serving as a detector is provided on a holding member holding a tension roller supporting a transfer belt so that the sensor is opposed to the tension roller with the transfer belt therebetween.

In this image forming apparatus, the shaft of the tension roller and the image reading sensor are held by the holding member. Therefore, if the holding member is damaged (for example, there is a case in which when the unit is detached from the image forming apparatus to replace the transfer belt, the holding member mistakenly strikes against the main body of the image forming apparatus), the detection accuracy of the sensor deteriorates due to change of the position of the light spot formed by the sensor and the distance between the sensor and the transfer belt. In addition, it is necessary for the holding member to have good dimensional accuracy so that the accuracy of the sensor can be satisfactorily shown.

For these reasons, the present inventors recognized that there is a need for an image forming apparatus which includes a transfer belt tightly stretched by a driving roller and a tension roller, and a detector optically detecting a mark (such as a toner image) on a surface of the transfer belt, wherein the detector is accurately positioned relative to the tension roller so that the position of a light spot formed by the detector is hardly changed and thereby the mark on the transfer belt can be accurately detected by the detector.

SUMMARY

This patent specification describes a novel image forming apparatus, one embodiment of which includes an image bearing member configured to bear a toner image thereon; a driving roller; a tension roller movable in such a direction that the interval between the driving roller and the tension roller changes; a transfer belt which is tightly stretched by the driving roller and the tension roller to feed a receiving material while being contacted therewith so that the toner image on the image bearing member is transferred onto the receiving material or to directly receive the toner image from the image bearing member; and a detector which is opposed to the tension roller with the transfer belt therebetween to optically detect a mark formed on the surface of the transfer belt.

The detector is movably supported while biased toward the tension roller, and the moving direction of the tension roller is substantially the same as the optical axis of detection light emitted by the optical detector. In addition, the image forming apparatus includes a regulator to regulate movement of the tension roller and the detector in a direction perpendicular to the moving direction of the tension roller.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

The present invention will be described by reference to drawings.

Figure 1:
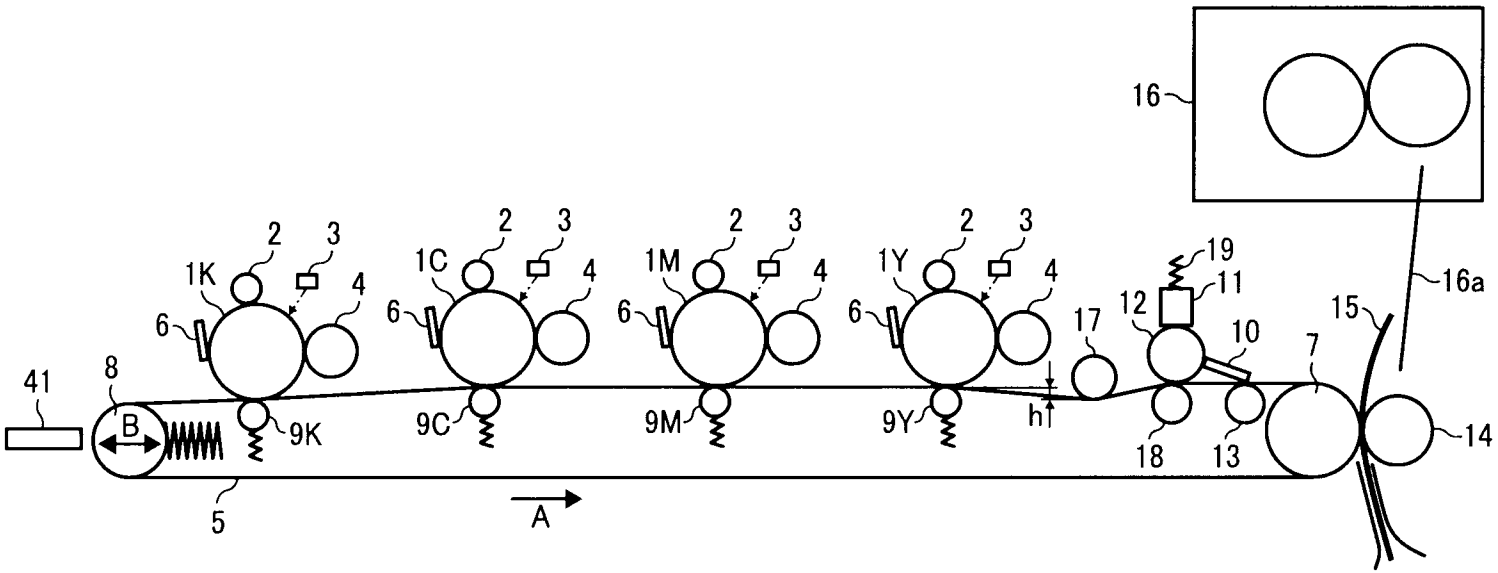
FIG. 1 is a schematic view illustrating a main portion of a color image forming apparatus, which is one example of the image forming apparatus of the present invention.

FIG. 1 is a schematic view illustrating a main portion of a color image forming apparatus, which is one example of the image forming apparatus of the present invention.

The color image forming apparatus illustrated in FIG. 1 is a quad tandem color image forming apparatus having an intermediate transfer belt 5 serving as a transfer belt, and four image forming units for forming yellow (Y), magenta (M), cyan (C) and black (K) color toner images are arranged side by side at regular intervals while extending in a moving direction of the intermediate transfer belt 5 indicated by an arrow A.

The image forming units have the same configuration except that different color toners are used therefor, and each of the image forming units includes a drum-shaped photoreceptor 1 (1Y, 1M, 1C and 1K) serving as an image bearing member, a charger 2 configured to charge the surface of the photoreceptor, an irradiator 3 configured to irradiate the charged photoreceptor with a light beam to form an electrostatic latent image on the photoreceptor, a developing device 4 configured to develop the electrostatic latent image using a color toner (i.e., a yellow, magenta, cyan or black color toner), and a cleaning blade 6 configured to clean the surface of the photoreceptor, wherein the charger, developing device, and cleaning blade are arranged around the photoreceptor.

The irradiator 3 adjusts the light intensity depending on the detected resistance of the intermediate transfer belt 5 as mentioned below. The developing device 4 includes four developing devices, i.e., yellow, magenta, cyan and black color image developing devices configured to develop electrostatic latent images formed on the photoreceptors 1Y, 1M, 1C and 1K using yellow, magenta, cyan and black color toners, respectively. When a full color image is formed, the yellow, magenta, cyan and black color image developing devices 4 form yellow, magenta, cyan and black color toner images in this order, and the Y, M, C and K color toner images are transferred onto a surface of the intermediate transfer belt 5 so as to be overlaid, thereby forming a combined multi-color toner image on the intermediate transfer belt. The combined multi-color toner image is then transferred onto a receiving material 15, and then fixed to the receiving material by a fixing device 16, resulting in formation of a full color image.

The intermediate transfer belt 5 is tightly stretched by a driving roller 7 and a tension roller 8, which is movable in directions indicated by a double-headed arrow B so that the interval between the driving roller and the tension roller changes. Since the driving roller 7 is rotated by a driving motor (not shown), the intermediate transfer belt 5 is rotated in the direction A. In this example, the moving speed of the intermediate transfer belt 5 (i.e., the process speed) is 150 mm/sec. Four primary transfer bias rollers 9Y, 9M, 9C and 9K are provided so as to be contacted with the inner surface of the intermediate transfer belt 5 while opposed to the photoreceptors 1Y, 1M, 1C and 1K, respectively. In addition, a first counter roller 13 serving as a counter roller of a belt cleaner 10, and a second counter roller 18 serving as a counter roller of a lubricant applicator (brush) 12 are also provided so as to be contacted with the inner surface of the intermediate transfer belt 5. These rollers are supported by two side plates of a transfer belt unit (not shown) provided on both sides of the intermediate transfer belt 5.

The primary transfer bias rollers 9Y, 9M, 9C and 9K are arranged so as to be opposed to the photoreceptors 1Y, 1M, 1C and 1K, respectively, with the intermediate transfer belt 5 therebetween, and a predetermined bias (+1,800V in this example) is applied to each of the primary transfer bias rollers.

The intermediate transfer belt 5 has one or more layers, each of which is typically made of a material such as a polyvinylidene fluoride resin (PVDF), an ethylene-tetrafluoroethylene copolymer(ETFE),apolyimide (PI) and a polycarbonate resin (PC). The layer(s) includes an electroconductive material such as carbon black so that the volume resistivity and surface resistivity of the intermediate transfer belt 5 are controlled in a range of from $10^8$ to $10^{12}$ Ω·cm and in a range of from $10^9$ to $10^{13}$ Ω/□, respectively. If desired, a release layer may be formed on the surface of the intermediate transfer belt 5.

Specific examples of the material for use in the release layer include, but are not limited thereto, fluorocarbon resins such as ethylene-tetrafluoroethylene copolymers (ETFE), polytetrafluoroethylene (PTFE), polyvinylidene fluoride (PVDF), perfluoroalkoxy-fluorocarbon resins (PEA), tetrafluoroethylene-hexafluoropropylene copolymers (FEP), and polyvinylidene fluoride (PVF).

The intermediate transfer belt 5 is typically prepared by a pour molding method or a centrifugal molding method, and the surface of the intermediate transfer belt may be polished, if desired. When the volume resistivity of the intermediate transfer belt 5 is greater than the above-mentioned range, a higher transfer bias has to be applied thereto, resulting in increase of the electric power consumption, thereby increasing running costs of the image forming apparatus. In addition, the potential of the intermediate transfer belt 5 increases in the primary transfer process or the secondary transfer process in which a receiving material is released from the intermediate transfer belt. In this case, a discharger has to be provided to discharge the residual charges of the intermediate transfer belt because it becomes difficult for the intermediate transfer belt to perform self discharging due to the high volume resistivity thereof.

When the volume resistivity and surface resistivity of the intermediate transfer belt 5 are less than the respective ranges mentioned above, good results such that the potential thereof decreases, and the intermediate transfer belt easily performs self discharging can be produced. However, when a transfer bias is applied to the intermediate transfer belt, a current flows along the surface of the intermediate transfer belt, thereby causing a toner image scattering problem in that a toner image is scattered in a transfer process. Therefore, the volume resistivity and surface resistivity of the intermediate transfer belt 5 are preferably controlled so as to fall in the respective ranges mentioned above.

The volume resistivity and surface resistivity of the intermediate transfer belt 5 are measured with a high resistance meter (HIGHRESTA IP from Mitsubishi Chemical Corp.) using a probe (HRS) having an inner electrode having a diameter of 5.9 mm and a ring electrode having an inner diameter of 11 mm. When the volume resistivity of an intermediate transfer belt is measured using the high resistance meter, a voltage of 100V is applied between the front surface (inner electrode) and the back surface (back electrode) of the intermediate transfer belt, and the volume resistivity is determined on the basis of the current at a time 10 seconds after start of application of the voltage. When the surface resistivity is measured using the high resistance meter, a voltage of 500V is applied between the inner electrode and the ring electrode, which are contacted with the front surface of the intermediate transfer belt, and the surface resistivity is determined on the basis of the current at a time 10 seconds after start of application of the voltage.

The cleaning blade 10, which is made of a urethane rubber, is pressed to the surface of the intermediate transfer belt 5 to block residual toner particles with the blade, resulting in cleaning of the surface of the intermediate transfer belt. In order to satisfactorily perform the cleaning operation, it is preferable to scrape off a solid lubricant 11 (such as a fatty acid metal salt) with the brush 12 to apply the lubricant to the surface of the intermediate transfer belt 5. Suitable materials for use as the solid lubricant include fatty acid metal salts having a linear hydrocarbon structure. Specific examples of such fatty acid metal salts include zinc, aluminum, calcium, magnesium and lithium salts of stearic acid, palmitic acid, myristic acid, and oleic acid. The solid lubricant 11 preferably includes one or more of the fatty acid metal salts.

Among such fatty acid metal salts, zinc stearate is preferably used because zinc stearate is produced on a large scale while used as a lubricant for various applications, and has low costs and good stability and reliability in quality. In this regard, such commercially produced zinc stearate typically includes other fatty acid metal salts, metal oxides and free fatty acids, wherein the contents thereof change depending on the products.

The solid lubricant 11 is applied little by little while having a power form. Specific examples of the method of applying the lubricant include a method in which a block of a lubricant is scraped off with a member such as brushes to apply the lubricant to the surface of the intermediate transfer belt, and a method in which a lubricant is externally added to the toner used. However, the second-mentioned method has a drawback in that the entire surface of the intermediate transfer belt cannot be necessarily coated always with the lubricant, and therefore the first-mentioned method is preferably used.

In order that the solid lubricant 11 is securely scraped off using the brush 12 in this example, the solid lubricant is pressed toward the brush by a pressing member 19 by a force of from 1N to 4N. The width of the solid lubricant 11 is greater than that of the maximum width of images to be formed on the intermediate transfer belt 5, and is not less than 304 mm. In addition, the width of the brush 12 is greater than that of the solid lubricant 11 so that the lubricant can be evenly scraped off.

In order to prevent vibration of the intermediate transfer belt 12 caused by contact of the brush 12 therewith, the intermediate transfer belt 5 is pressed by a pressure roller 17 so as to be recessed at a depth of h as illustrated in FIG. 1 while a counter roller 18 is provided so as to be opposed to the brush. In this example, the pressure roller 17 is provided so as to contact the outer surface of the intermediate transfer belt 12, but the same effect can be produced when the pressure roller is provided so as to contact the inner surface thereof.

A secondary transfer roller 14 is arranged so as to be opposed to the driving roller 7, and has configuration such that an elastic layer made of an elastic material such as polyurethane and including an electroconductive material so as to have a resistance of from $10^6$ to $10^{10}$ Ω is formed on a rod made of a metal such as SUS. When the resistance of the elastic layer is greater than $10^{10}$ Ω, the secondary transfer bias current tends to be lower than the desired current, and therefore a higher voltage has to be applied to the secondary transfer roller 14, resulting in increase of the cost of the power source of the image forming apparatus. In addition, when a high voltage is applied to the secondary transfer roller 14, discharging tends to occur in a space in the vicinity of the secondary transfer nip formed by the intermediate transfer belt 5 and the secondary transfer roller, thereby forming a white spot image on a half tone toner image. By contrast, when the resistance of the elastic layer is lower than $10^6$ Ω, a toner image consisting of overlaid toner images (for example, a toner image in which two or three different color toner images are overlaid) and a monochrome toner image cannot be satisfactorily transferred. The reason therefor is as follows. Since the resistance of the secondary transfer roller 14 is low, a sufficient amount of current flows when a monochrome toner image is transferred even when the secondary transfer bias is relatively low. However, a higher secondary transfer bias has to be applied to the secondary transfer roller 14 to transfer an overlaid toner image. Therefore, when a relatively high secondary transfer bias is applied to the secondary transfer roller 14 to transfer an overlaid toner image, an excess transfer current flows through the monochrome toner image, resulting in deterioration of transfer efficiency of the monochrome toner image.

The method for measuring the resistance of the secondary transfer roller 14 is as follows. The secondary transfer roller is set on an electroconductive metal plate and a load of 4.9N is applied to each end portion of the metal shaft of the roller (i.e., a load of 9.8N in total is applied to the roller). Next, a voltage of 1,000V is applied between the metal shaft and the metal plate while measuring the current flowing therebetween. The resistance of the secondary transfer roller is calculated from the current and the applied voltage.

In addition, a driving force is applied to the secondary transfer roller 14 using a driving gear (not shown) so that the roller is rotated at substantially the same peripheral speed as that of the intermediate transfer belt 5.

The secondary transfer operation is performed while controlling the transfer current at a predetermined current. In this example, the transfer current is +30 μA.

When a full color image is formed in this image forming apparatus, yellow, magenta, cyan and black color toner images formed on the respective photoreceptors 1Y, 1M, 1C and 1K are sequentially transferred onto the intermediate transfer belt 5, which is rotated in the direction A, resulting in formation of a combined color toner image in which the four color toner images are overlaid.

Meanwhile the receiving material 15 is timely fed to the secondary transfer nip by feeding rollers, and a pair of registration rollers (now shown) so that the combined color toner image on the intermediate transfer belt 5 is transferred onto the predetermined position of the receiving material at the secondary transfer nip. The receiving material bearing the combined color toner image is fed to the fixing device 16 along a guide 16*a* so that the combined color toner image is fixed to the receiving material, resulting in formation of a full color image. The receiving material bearing the full color image thereon is then discharged from the image forming apparatus by a discharging roller (not shown).

Figure 3:
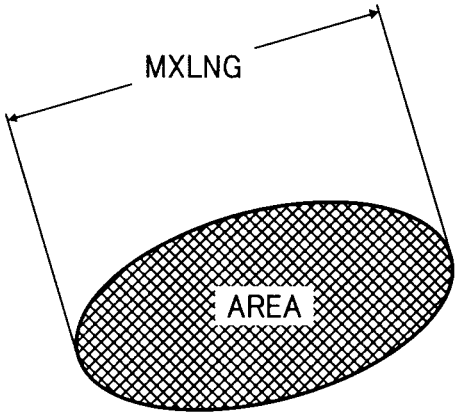
FIG. 3 is a schematic view used for describing the way to determine a shape factor SF-1 of a toner.
Figure 4:
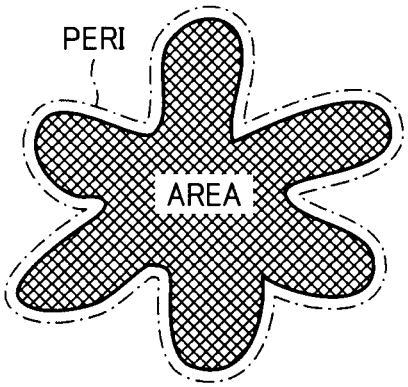
FIG. 4 is a schematic view used for describing the way to determine another shape factor SF-2 of a toner.

The toners used for the image forming apparatus are polymerized toners prepared by a polymerization method. Each of the toners preferably has an average shape factor SF-1 of from 100 to 180, and another average shape factor SF-2 of from 100 to 180. FIGS. 3 and 4 are schematic views illustrating a toner particle for describing the way to determine the shape factors SF-1 and SF-2 of the toner particle.

The shape factor SF-1 represents the roundness of a particle of toner, and is expressed by the following equation (1):

$$SF\text{-}1=\{(MXLNG)^2/AREA\}\times(100\,\pi/4) \quad (1),$$

wherein MXLNG represents the maximum length of a projected image of a toner particle on a plane, and AREA represents the area of the projected image.

When the toner particle is spherical, the shape factor SF-1 is 100. As the shape factor SF-1 of toner increases, the particle form of the toner is more differentiated from the spherical form. The average shape factor SF-1 of a toner is determined by averaging the SF-1 of multiple particles of the toner.

The shape factor SF-2 represents the concavity and convexity of a particle of toner, and is expressed by the following equation (2):

$$SF\text{-}2=\{(PERI)^2/AREA\}\times(100/4\,\pi) \quad (1),$$

wherein PERI represents the peripheral length of a projected image of a toner particle on a plane, and AREA represents the area of the projected image.

When the toner particle is spherical, the shape factor SF-2 is 100. As the shape factor SF-2 of toner increases, the toner has a rougher surface. The average shape factor SF-2 of a toner is determined by averaging the SF-2 of multiple particles of the toner.

The average shape factors SF-1 and SF-2 can be determined by a scanning electron microscope (SEM) and an image analyzer. Specifically, a microphotograph of a toner is taken using a SEM (S-800 from Hitachi Ltd.), and the photograph is analyzed using an image analyzer (LUSEX3 from Noreco Corp.).

When the particle form of the toner becomes close to the spherical form (i.e., the average shape factors SF-1 and SF-2 approach to 100), toner particles make point contact with each other, and thereby the attraction between the toner particles is decreased, resulting in increase of the fluidity of the toner. In addition, the attraction between the toner particles and a photoreceptor decreases, resulting in enhancement of the transfer rate of a toner image in the primary and secondary transfer processes. By contrast, when one of the average shape factors SF-1 and SF-2 is greater than 180, the transfer rate of a toner image deteriorates and in addition toner particles remaining on the intermediate transfer belt 5 cannot be easily removed (i.e., the cleanability of the toner deteriorates).

The toner for use in the image forming apparatus of the present invention preferably has a volume average particle diameter of from 4 μm to 10 μm. When the volume average particle diameter is less than 4 μm, a background development problem in that background of images is soiled with toner particles tends to occur. In addition, fluidity of the toner deteriorates, and toner particles tend to aggregate, thereby causing an omission problem in that a white spot is formed in a solid image. By contrast, when the volume average particle diameter is greater than 10 μm, a toner scattering problem in that toner particles scatter around a developing device tends to be caused and high definition images cannot be formed. The volume average particle diameter of the toner used in this example is 6.5 μm.

Among the primary transfer rollers 9Y, 9M, 9C and 9K, the rollers 9Y, 9M and 9C for transferring color images can be attached to or detached from the intermediate transfer belt 5 by an attaching/detaching member (not shown) so that the intermediate transfer belt can be attached to or detached from the photoreceptors 1Y, 1M and 1C for forming Y, M and C color images.

Figure 2:
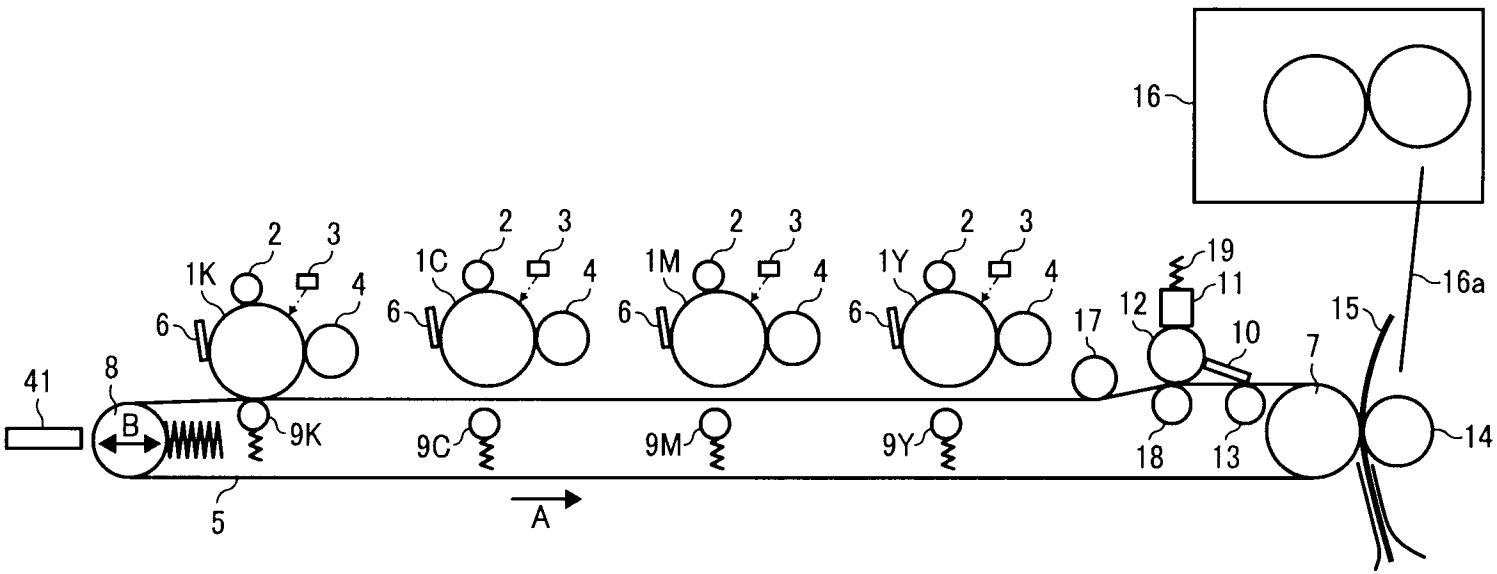
FIG. 2 is a schematic view illustrating the color image forming apparatus in a monochrome mode, in which only a black color image is formed.

FIG. 2 illustrates the image forming apparatus achieving a monochrome mode. In the image forming apparatus illustrated in FIG. 2, the primary transfer rollers 9Y, 9M and 9C are detached from the intermediate transfer belt 5, and only the primary transfer roller 9K is attached to the intermediate transfer belt to form a black image.

When an order to form a full color image is made for the image forming apparatus in the monochrome mode, the primary transfer rollers 9Y, 9M and 9C are attached to the intermediate transfer belt 5 so that the intermediate transfer belt is contacted with the photoreceptors 1Y, 1M and 1C while slightly wound around the photoreceptors. The primary transfer roller 1K is always attached to the intermediate transfer belt 5 independently of attachment and detachment of the other primary transfer rollers 9Y, 9M and 9C, and therefore the intermediate transfer belt is always attached to the photoreceptor 1K in such a manner as to be slightly wound around the photoreceptor. Thus, when the image forming apparatus is in the monochrome mode, the path of the intermediate transfer belt 5 is different from that when the image forming apparatus is in the full color mode. Therefore, the position of the tension roller 8 moves in the directions B when the mode of the image forming apparatus changes from the monochrome mode to the full color mode or vice versa.

In electrophotographic image forming apparatuses, a toner image with a predetermined pattern (i.e., a patch image) is typically formed on a surface of an intermediate transfer belt, which is a mark used for detecting the image density and/or position of a toner image formed on the intermediate transfer belt, to determine whether the image density and the position of the toner image are proper. If the image density and the position of the toner image are improper, the image forming apparatus performs a control operation on the basis of the detection results.

Particularly, when a reflection sensor, which forms a light spot on a mark and which detects reflection light reflecting from the mark, is used as the sensor, the detection property of the sensor is greatly influenced by the distance between the light irradiating point/light receiving point of the sensor and the mark formed on an intermediate transfer belt. Therefore, such a reflection sensor is typically provided so as to face to a portion of the intermediate transfer belt, which is hardly changed in position, e.g., a portion of the intermediate transfer belt supported by a driving roller or a belt form maintaining member such as a plate. Recently, there is a strong need for a small-sized image forming apparatus. However, there is no space in the vicinity of the driving roller 5 for such a sensor because the secondary transfer roller 14 and a guide for guiding a receiving material have to be provided in the vicinity of the driving roller when the intermediate transfer belt is supported by two rollers such as the driving roller 7 and the tension roller 8. When a belt form maintaining member is provided on the backside of the intermediate transfer belt 5, problems in that the belt is easily abraded by the member, and toner images on the belt are scattered due to increase in load on the belt, and physical or electrostatic friction between the belt and the member tend to occur. Therefore, it is necessary to reduce the friction therebetween or to properly attach or detach the belt form maintaining member to or from the intermediate transfer belt. For these reasons, it is preferable to provide a reflection sensor so as to face the tension roller 8. As illustrated in FIG. 1, a toner image detection sensor 41 for optically detecting a mark formed on the intermediate transfer belt 5 is provided so as to face the tension roller 8 and to extend in a direction parallel to the main scanning direction (i.e., the width direction of the tension roller) to correct the image density and position of a toner image. In this example, the toner image detection sensor 41 includes plural sensors, each of which can detect a mark in a small range and which are provided side by side in the main scanning direction.

The operation of the toner image detection sensor 41 is as follows. The toner image detection sensor 41 irradiates a toner image serving as a mark (hereinafter referred to as a correction pattern toner image) formed on the surface of the intermediate transfer belt 5 with light emitted by a LED of the sensor and receives light reflected from the correction pattern toner image to determine the density of the correction pattern toner image. The image forming apparatus determines the proper developing bias on the basis of the detected image density to prevent variation of the image density caused by deterioration of the photoreceptor and toner, and change of environmental conditions.

In addition, correction pattern color toner images, which are formed on the surface of the intermediate transfer belt 5, are detected by the respective toner image detection sensors to determine the positional differences therebetween. The image forming apparatus determines the proper laser beam irradiating timing and developing timing on the basis of the detected positional differences of the correction pattern color toner images to prevent formation of misaligned Y, M, C and K color toner images.

The support/guide construction of the toner image detection sensor 41 and the tension roller 8 will be described by reference to FIGS. 5 and 6.

Figure 5:
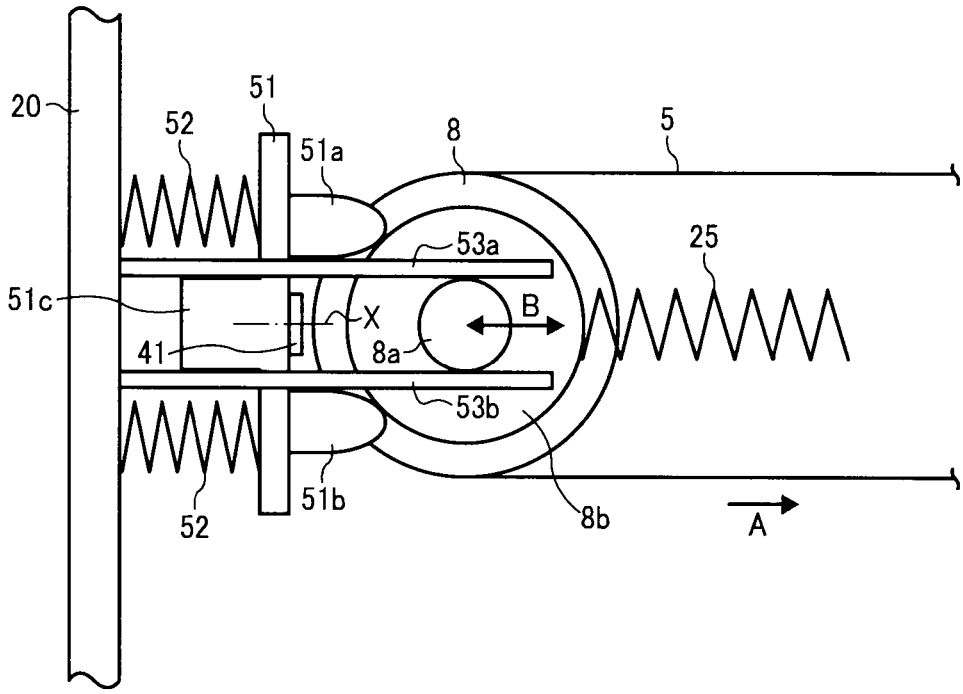
FIGS. 5 and 6 are schematic side view and plan view illustrating an example of support/guide construction of a toner image detector and a tension roller for use in the image forming apparatus of the present invention.
Figure 6:
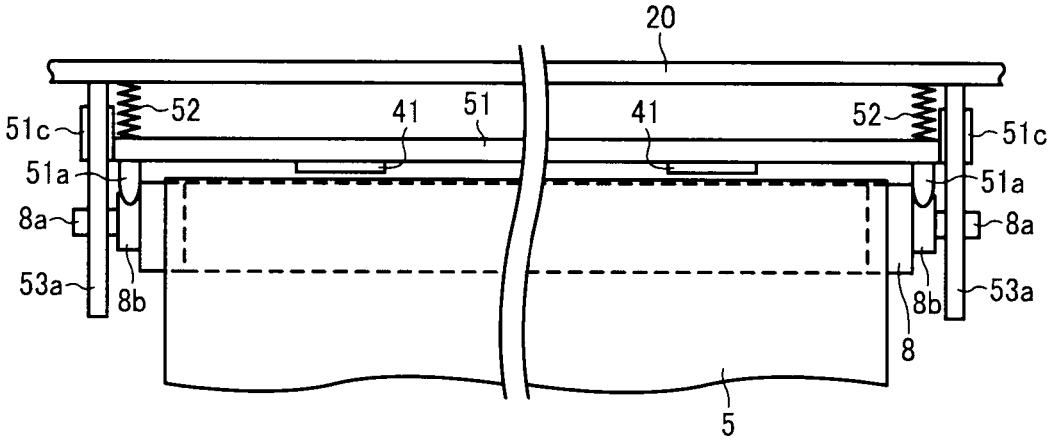

FIGS. 5 and 6 are schematic side view and plan view respectively illustrating an example of support/guide construction of a toner image detector and a tension roller for use in the image forming apparatus of the present invention.

Referring to FIGS. 5 and 6, each of the toner image sensors 41 serving as a detector for detecting Y, M, C and K toner images is provided on a portion of a sensor plate 51 extending in the main scanning direction parallel to the axis of the tension roller 8. The sensor plate 51 has a pair of picks 51*a* and 51*b*, which is a contact portion (hereinafter sometimes referred to as a first contact portion) and which is provided on a surface of each end portion of the plate in the main scanning direction, wherein the surface of the plate faces the tension roller. The tips of the pair of picks 51*a* and 51*b* are contacted with a contact portion 8*b* (hereinafter sometimes referred to as a second contact portion) of the tension roller 8, which portion has the same axis as a rotation shaft 8*a* of the tension roller. In this regard, it is possible to consider a combination of the toner image sensor 41 and the sensor plate 51 supporting the toner image sensor as the detector.

A spring 52 is provided so as to be located between another surface of the sensor plate 51 and a surface of a fixed body 20 of the image forming apparatus, thereby biasing the sensor plate 51 toward the tension roller 8. In addition, the second contact portion 8*b* of the tension roller 8 is biased toward the sensor plate 51 by a spring 25 and a tension adjusting mechanism (not shown).

When the toner image sensor 41 and the tension roller 8 have such a constitution, the distance between the toner image sensor 41 and the intermediate transfer belt 5 supported by the tension roller 8 can be always held constant.

A pair of parallel guide members 53*a* and 53*b* serving as a regulator is provided on the surface of each end portion of the fixed body 20 in such a manner as to sandwich the rotation shaft 8*a* of the tension roller 8 to regulate movement of the tension roller 8 in the vertical direction perpendicular to the moving directions B of the tension roller.

Further, a positioning member 51*c* is inserted into the pair of parallel guide members 53*a* and 53*b*, thereby regulating movement of the sensor plate 51 and the toner image detection sensor 41 in the vertical direction. Therefore, an optical axis X of the toner image sensor 41 is controlled so as to be substantially the same as the moving directions B of the tension roller 8.

Therefore, even when the position of the tension roller 8 is changed in the directions B due to change of the mode of the image forming apparatus of from the monochrome mode to the full color mode or expansion and contraction of the intermediate transfer belt caused by change of environmental conditions, the distance between the correction pattern toner images and the toner image sensor 41 and the position of the light spot formed by light emitted by the toner image sensor are not changed, thereby minimizing the detection error and preventing mis-detection and mis-correction.

Thus, by providing the pair of guide members 53*a* and 53*b*, the pair of picks 51*a* and 51*b* serving as the first contact portion, and the second contact portion 8*b* on each of the end portions of the sensor plate 51 and the tension roller 8 as mentioned above, the tension roller and the sensor plate can be moved in the directions B without slanting and the distance between the correction pattern toner images and the toner image sensor 41 can be held constant.

In this example, the tip of the picks 51*a* and 51*b* serving as the first contact portion is rounded as illustrated in FIG. 5 so as to make a point contact with the surface the second contact portion 8*b*. When the picks 51*a* and 51*b* have such a rounded tip, the friction between the picks and the second contact portion 8*b* can be decreased. However, the shape of the tip of the picks 51*a* and 51*b* is not limited thereto, and the tip may have a flat surface. Alternatively, the tip may have such a form as to be engaged with the surface of the second contact portion 8*b*.

The second contact portion 8*a* is preferably a collar which can rotate independently of the rotation shaft 8*a* of the tension roller 8. In this regard, it is possible that even when the tension roller 8 is rotated, the second contact portion 8*b* is not rotated, thereby reducing friction between the picks 51*a* and 51*b* and the second contact portion 8*b*, resulting in enhancement of the durability of the detector having the picks and the tension roller. Namely, the detection accuracy of the detector hardly deteriorates even after long repeated use.

Alternatively, the second contact portion 8*b* may be a shaft of the tension roller 8, wherein the shaft is not rotated even when the tension roller is rotated unlike the rotation shaft 8*a*. Since the shaft is not rotated, there is little friction between the picks 51*a* and 51*b* and the shaft. In this regard, since the tension roller 8 has to be rotated together with the intermediate transfer belt 5, a roller portion (rotating portion) has to be provided on the shaft. The roller portion may be made of a metal, or an elastic material such as rubber and sponge.

In this example, the detector is constituted of the toner image sensor 41, the sensor plate 51 supporting the toner image sensor, the pair of picks 51*a* and 51*b* provided on each end portion of the sensor plate so as to extend toward the intermediate transfer belt 5, and the springs 52 serving as a biasing member and located between the body 20 and the sensor plate 51. Plural (for example, three) toner image sensors are provided as the toner image sensor 41, but only one toner image sensor can be used as the toner image sensor 41.

Figure 7:
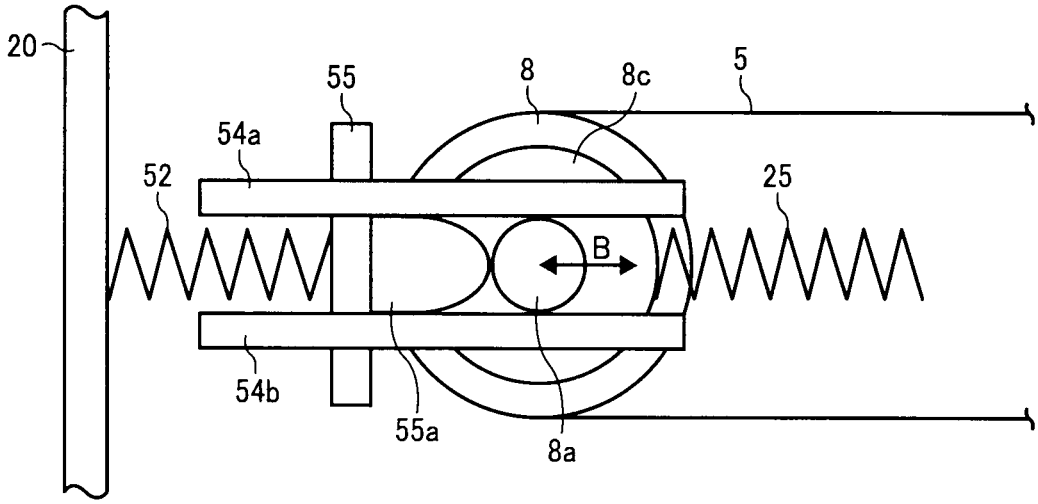
FIG. 7 is a schematic side view illustrating another example of support/guide construction of a toner image detector and a tension roller for use in the image forming apparatus of the present invention.

Next, another example of the support/guide construction of the toner image sensor 41 and the tension roller 8 will be described by reference to FIG. 7. In this regard, the members illustrated in FIGS. 5 and 6 have the same reference numbers in FIG. 7, and description of the members are omitted here.

In this example, a pair of guide members 54*a* and 54*b* for slidably guiding the shaft 8*a* of the tension roller 8 is provided on a side plate of a transfer unit. A pick 55*a* is provided on each end portion of a sensor plate 55, on which the toner image sensor 41 is provided, so that the tip of the pick is contacted with the surface of the shaft 8*a* of the tension roller 8. In addition, a spring 52 is provided on each end portion of the sensor plate 55 so as to be located between the backside of the sensor plate and the body 20 to press the pick 55*a* toward the shaft 8*a*.

A collar 8*c*, which corresponds to the collar 8*b*, is provided on each end portion of the tension roller 8 so as to be rotatable relative to the shaft 8*a* of the tension roller. The spring 25 of a tension adjusting mechanism (not shown) is contacted with the collar 8*c* to press the tension roller toward the body 20.

In this example, since the pick 55*a* strikes the shaft 8*a* serving as the second contact portion, the toner image sensor 41 provided on the sensor plate 55 is positioned with precision. In FIG. 7, the toner image sensor is not illustrated because of being hidden by the pick 55*a*.

The pair of guide members 54*a* and 54*b* serving as a regulator slidably guides the shaft 8*a* of the tension roller 8 and the pick 55*a*. Therefore, the pair of guide members 54*a* and 54*b* regulates movement of the tension roller 8 and the sensor plate 55 in the direction (i.e., vertical direction) perpendicular to the moving directions B of the tension roller.

Therefore, the optical axis X of the toner image sensor provided on the sensor plate 55 is controlled so as to be substantially the same as the moving direction of the tension roller 8. Therefore, even when the position of the tension roller 8 is changed in the moving directions B thereof, the distance between the correction pattern toner images and the toner image sensor 41 and the position of the light spot formed by light emitted by the sensor are not changed, thereby minimizing the detection error and preventing mis-detection and mis-correction.

In this example, the toner image detector is constituted of the toner image sensor (not illustrated in FIG. 7), the sensor plate 55 supporting the sensor, the pick 55*a* provided on each end portion of the sensor plate so as to extend toward the intermediate transfer belt 5, and the spring 52 serving as a biasing member and located between the body 20 and the sensor plate.

It is also possible for the tension roller 8 of this example to have configuration such that the shaft 8*a* is a fixed shaft, and a roller portion is rotated around the shaft. In this case, the shaft is not rotated even when the tension roller 8 (roller portion) is rotated, and therefore friction between the pick 55*a* and the shaft 8*a* serving as the second contact portion can be dramatically reduced.

In the examples mentioned above, since the same guiding member is used for regulating movement of the tension roller 8 and the toner image sensor 41, variation of position of the toner image sensor relative to the tension roller can be reduced. Therefore, information on a toner image formed on the intermediate transfer belt 5 can be precisely detected, thereby making it possible to reliably perform image density correction and position variation correction.

Hereinbefore, preferable examples have been described. However, the present invention is not limited thereto, and modifications and variations of the examples are possible. It is needless to say that such modified versions are also included in the present invention.

For example, the present invention can also be applied to a direct transfer belt, which feeds a receiving material on which toner images formed on one or more image bearing members are directly transferred, instead of the intermediate transfer belt 5 mentioned above.

In addition, the above-mentioned mechanism for attaching and detaching the transfer belt to and from plural image bearing members may be a mechanism for attaching and detaching the transfer belt to and from only one image bearing member.

Further, the present invention is not limited to color image forming apparatuses, and can also be used for monochrome image forming apparatuses having a transfer belt.

Furthermore, the detector is not limited to an optical sensor for optically detecting a toner image, and may be an optical sensor for detecting a timing mark or a home position mark formed on a transfer belt.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2010-042991, filed on Feb. 26, 2010, the entire contents of which are herein incorporated by reference.

What is claimed is:

1. An image forming apparatus comprising:

at least one image bearing member to bear a toner image thereon;

a driving roller;

a tension roller movable in such a direction that a distance between the driving roller and the tension roller changes;

a transfer belt which is stretched by the driving roller and the tension roller while rotated by the driving roller to feed a receiving material while being contacted therewith so that the toner image on the image bearing member is transferred onto the receiving material or to directly receive the toner image from the image bearing member;

a detector opposed to the tension roller with the transfer belt therebetween to optically detect a mark on a surface of the transfer belt, wherein the detector is movably supported while biased toward the tension roller, and the moving direction of the tension roller is substantially same as an optical axis of detection light emitted by the detector; and a regulator to regulate movement of the tension roller and the detector in a direction perpendicular to the moving direction of the tension roller.

2. The image forming apparatus according to claim 1, wherein the detector or a supporter thereof has a first contact portion contacted with a second contact portion of the tension roller, and wherein the second contact portion is rotatably located on a rotatable shaft of the tension roller.

3. The image forming apparatus according to claim 2, wherein the first contact portion makes a point contact with the second contact portion.

4. The image forming apparatus according to claim 2, wherein the tension roller has the second contact portion at each end portion in an axial direction thereof, and the detector or the supporter thereof has the first contact portion at each end portion thereof so that the first contact portions contact with the corresponding second contact portions.

5. The image forming apparatus according to claim 1, wherein the detector or a supporter thereof has a first contact portion contacted with a second contact portion of the tension roller, and wherein the tension roller has a fixed shaft serving as the second contact portion, and a roller portion rotatable on the fixed shaft.

6. The image forming apparatus according to claim 5, wherein the first contact portion makes a point contact with the second contact portion.

7. The image forming apparatus according to claim 5, wherein the tension roller has the second contact portion at each end portion in an axial direction thereof, and the detector or the supporter thereof has the first contact portion at each end portion thereof so that the first contact portions contact with the corresponding second contact portions.

8. The image forming apparatus according to claim 1, wherein the mark is the toner image, which is transferred from the image bearing member onto the transfer belt, and wherein the detector includes a toner image sensor optically detecting the toner image.

9. The image forming apparatus according to claim 8, including plural image bearing members, wherein the plural image bearing members bear different color toner images thereon, and wherein the transfer belt is a transfer belt to feed the receiving material, on which the different color toner images are sequentially transferred from the plural image bearing members to form a combined color toner image on the receiving material or an intermediate transfer belt to sequentially receive the different color toner images directly from the plural image bearing members to form a combined color toner image thereon.

10. The image forming apparatus according to claim 9, further comprising an attaching and detaching mechanism configured to attach and detach at least one of the plural image bearing members to and from the transfer belt.

* * * * *